US011377904B2

(12) United States Patent
Campagna

(10) Patent No.: US 11,377,904 B2
(45) Date of Patent: Jul. 5, 2022

(54) ROLLER SHADE FOR NON-RECTANGULAR WINDOWS

(71) Applicant: Crestron Electronics, Inc., Rockleigh, NJ (US)

(72) Inventor: Michael Campagna, Woodcliff Lake, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 157 days.

(21) Appl. No.: 16/707,665

(22) Filed: Dec. 9, 2019

(65) Prior Publication Data

US 2020/0190902 A1 Jun. 18, 2020

Related U.S. Application Data

(60) Provisional application No. 62/779,648, filed on Dec. 14, 2018.

(51) Int. Cl.
*E06B 9/58* (2006.01)
*E06B 9/44* (2006.01)

(52) U.S. Cl.
CPC ..... *E06B 9/58* (2013.01); *E06B 9/44* (2013.01); *E06B 2009/583* (2013.01)

(58) Field of Classification Search
CPC ..... E06B 9/58; E06B 9/44; E06B 2009/583; E06B 2009/587; E06B 9/581; E06B 9/60; E06B 2009/2482; E06B 2009/2494; B60J 1/2013; B60J 1/2044; B60J 1/2052
See application file for complete search history.

(56) References Cited

U.S. PATENT DOCUMENTS

| | | | |
|---|---|---|---|
| 449,042 | A | 3/1891 | Haswell |
| 471,114 | A | 3/1892 | Haswell |
| 493,162 | A | 3/1893 | Haswell |
| 761,837 | A | 6/1904 | Hopkins |
| 771,179 | A | 9/1904 | Scheif |
| 808,242 | A | 12/1905 | Jordan |
| 984,313 | A | 2/1911 | Stiles |
| 1,050,459 | A | 1/1913 | Hotaling |

(Continued)

OTHER PUBLICATIONS

Lutron Electronics Co., Inc., Cable Guided Roller Shade Install Guide, P/N 045-336 Rev B, 2010.

(Continued)

*Primary Examiner* — Daniel P Cahn
*Assistant Examiner* — Jeremy C Ramsey
(74) *Attorney, Agent, or Firm* — Crestron Electronics, Inc.

(57) ABSTRACT

A roller shade adapted to be installed in a non-rectangular structural opening comprising a roller tube, a shade material, a hem bar, and a pair of longitudinal side channels. The hem bar may be extendable and may comprise a pair of wheels at its opposite terminal ends. Each wheel is adapted to be retained by and travel within one of the longitudinal channels which are adapted to guide the hem bar assembly along the side jambs and control an extension of the extendable hem bar as the shade material is rolled on or unrolled from the roller tube and the distance between the side jambs changes. The roller shade may further comprise a pair of tension modules adapted to be attached to the hem bar proximate to one of the wheels to provide tension on the hem bar assembly.

13 Claims, 9 Drawing Sheets

(56) References Cited

U.S. PATENT DOCUMENTS 1,134,326 A 4/1915 Gambon
1,169,803 A 2/1916 Greenberg
1,446,747 A 2/1923 Hoyt
1,787,482 A 4/1928 Kimbell
1,841,730 A 3/1930 Hamm
1,807,769 A 6/1931 Wileman
1,912,579 A 8/1932 Hamm
1,986,773 A 10/1932 Hamm
3,721,285 A 3/1973 Debs
4,673,018 A 6/1987 Judkins
4,836,263 A 1/1989 Ament
4,865,109 A 9/1989 Sherman
4,880,045 A 11/1989 Stahler
4,979,775 A 12/1990 Klose
5,035,091 A 7/1991 Ebato
5,163,495 A 11/1992 Lichy
5,201,810 A 4/1993 Ojima et al.
5,280,818 A 1/1994 Ubelhart
5,287,908 A 2/1994 Hoffmann et al.
5,323,831 A 6/1994 Manthei
5,351,742 A 10/1994 Lichy
5,404,926 A * 4/1995 Ojima ..... B60J 1/2025 160/280
5,479,979 A * 1/1996 Hayashiguchi ..... E04F 10/0607 160/265
5,535,806 A 7/1996 Kold et al.
5,632,317 A * 5/1997 Krupke ..... E06B 9/13 160/264
5,915,447 A 6/1999 Lassen
6,086,133 A 7/2000 Alonso
6,119,758 A 9/2000 Coenraets
6,206,076 B1 3/2001 Stawski
6,273,173 B1 8/2001 Lassen
6,598,929 B2 7/2003 Schlecht et al.
7,059,376 B2 6/2006 Tussinger
7,117,918 B2 10/2006 Franssen
7,665,502 B2 2/2010 Dekker
7,971,625 B2 7/2011 Garmyn
8,056,601 B2 11/2011 Kirby et al.
8,113,264 B2 2/2012 Kirby et al.
8,622,112 B2 1/2014 Tremaine, III et al.
8,887,789 B2 11/2014 Tremaine, III et al.
9,303,452 B2 4/2016 Hofmann
9,382,756 B2 7/2016 Cheringal et al.
2003/0019588 A1 1/2003 Schmitz
2005/0263257 A1* 12/2005 Hansen ..... E06B 9/58 160/370.22
2008/0006373 A1 1/2008 Lin
2013/0153160 A1* 6/2013 Lin ..... B60J 1/2052 160/267.1
2015/0083349 A1* 3/2015 Hofmann ..... E06B 9/40 160/263
2016/0290039 A1 10/2016 Cheringal et al.
2016/0369555 A1 12/2016 Riemelmoser et al.

OTHER PUBLICATIONS

Roll-A-Shade, Exterior System, R-8.1, Aug. 14, 2013.
Crestron Electronics, Inc., Skylight Shade, Installation Guide—Doc. 7539A, (2036704), Sep. 2013.

* cited by examiner

ROLLER SHADE FOR NON-RECTANGULAR WINDOWS

BACKGROUND OF THE INVENTION

Technical Field

Aspects of the embodiments relate to shades, and more particularly to systems, methods, and modes for a roller shade for a non-rectangular window, such as trapezoidal, parallelogram, as well as other regular or irregular quadrilateral shaped windows, and which may be mounted in different orientations and tilt angles.

Background Art

Roller shades are effective in screening windows, doors, or the like, to achieve privacy and thermal effects. A roller shade typically includes a rectangular shade material, such as fabric, attached at its top end to a cylindrical rotating tube, called a roller tube, and at an opposite bottom end to a hem bar. The shade material is wrapped around the roller tube. The roller tube is rotated, either manually or via an electric motor, in a first direction to roll down the shade material to cover a window and in a second direction to roll up the shade material to uncover the window.

While windows are typically rectangular and positioned in a vertical orientation, some buildings employ odd shaped windows, such as trapezoidal or parallelogram windows, with tilted orientation. In such applications, typical roller shades with rectangular fabrics are inappropriate as they will not provide full coverage of the window, resulting in unsightly light gaps at the sides of the window. In addition, in typical roller shades, the bottom end of the fabric is free hanging such that the fabric will roll up and down perpendicular to the floor or the window sill. In tilted windows, however, it is desirous to have the shade material to hang and travel parallel to the window such that the fabric is sloped at the same angle as the window. Conventional window shades cannot fully conform to the uniquely shape and angled windows, such as trapezoidal or parallelogram windows.

Accordingly, a need has arisen for a roller shade for a non-rectangular window, such as a trapezoidal, parallelogram, as well as other regular or irregular quadrilateral shaped windows, and which may be mounted in different orientations and tilt angles.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for a roller shade for a non-rectangular window, such as a trapezoidal, parallelogram, as well as other regular or irregular quadrilateral shaped windows, and which may be mounted in different orientations and tilt angles.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to one aspect of the embodiments, a roller shade is provided adapted to be installed in a non-rectangular structural opening comprising a pair of sides jambs interconnected at their first ends by a first jamb and at their second ends by a second jamb. The roller shade comprises a roller tube adapted to be attached between the side jambs proximate to the first jamb, a shade material comprising and extending between a first end attached to the roller tube and a second end, and a shade drive unit operably connected to the roller tube and adapted to rotate the roller tube to roll or unroll the shade material. The shade material comprises a shape that corresponds to a shape of the structural opening such that the shade material substantially covers the structural opening when it is unrolled from the roller tube. The roller shade also comprises a pair of longitudinal side channels each comprising a longitudinal track and adapted to be attached along one of the side jambs, and a hem bar assembly attached to the second end of the shade material and comprising a pair of wheels at its opposite terminal ends, wherein each wheel is adapted to be retained by and travel within one of the longitudinal tracks. The roller shade further comprises a pair of tension modules adapted to be attached proximate to the second jamb, wherein each tension module comprises a retractable cable attached to the hem bar proximate to one of the wheels, wherein the tension modules are adapted to provide tension on the hem bar assembly.

According to an embodiment, the hem bar assembly further comprises a hollow housing with a pair opposite open ends and a pair of extendable arms each partially residing within the hollow housing and partially extending from one of the opposite open ends of the hollow housing, wherein each wheel of the hem bar assembly is attached to a terminal end of one of the pair of extendable arms. Each longitudinal side channel may be adapted to receive the terminal end of one of the pair of extendable arms. The longitudinal tracks may be adapted to guide the hem bar assembly along the side jambs and control an extension of the pair of extendable arms as distance between the side jambs changes. The pair of side jambs of the non-rectangular structural opening may be unparalleled causing the pair of extendable arms to extend from or retract into the open ends of the hollow housing as the shade material is rolled on or unrolled from the roller tube. According to an embodiment, the hem bar assembly further comprises a rotatable idler gear disposed within the hollow housing, wherein each of the pair of extendable arms comprise a gear rack adapted to engage the idler gear. According to an embodiment, the idler gear and the pair of gear racks cooperatively act as a synchronizing mechanism to synchronize a distance the pair of extendable arms extend out of the pair of open ends of the hollow housing. According to a further embodiment, the hollow housing comprises a plurality of rollers rotatably disposed about the extendable arms to guide the extendable arms therein. According to yet another embodiment, the hem bar assembly further comprises a plurality of rotatable interengaged idler gears disposed within the hollow housing, wherein each of the pair of extendable arms comprise a gear rack adapted to engage at least two of the idler gears, wherein the idler gears comprise different gear ratios to allow the pair of extendable arms to extend at different distances from the hollow housing.

According to an embodiment, the roller shade further comprises a fascia adapted to be attached to the second jamb to substantially conceal the pair of tension modules from view. The fascia may comprise a pair of holes through which the retractable cables exit the fascia. The retractable cables may extend into and are substantially concealed by the longitudinal side channels.

According to another embodiment, the first jamb is offset from the second jamb of the non-rectangular opening, wherein the roller tube is adapted to be attached between the side jambs at an angle with respect to the first jamb. The roller shade may further comprise a fascia adapted to be aligned with and attached to the first jamb to substantially conceal the angled roller tube from view. The roller tube may be adapted to be attached between the side jambs substantially perpendicularly to a direction of travel of the shade material. The hem bar assembly may be adapted to be attached to the second end of the shade material such that the hem bar assembly is parallel to the second jamb.

According to another aspects of the embodiments, a roller shade is provided adapted to be installed in a non-rectangular structural opening comprising a pair of sides jambs interconnected at their first ends by a first jamb and at their second ends by a second jamb, wherein the first jamb and the second jamb comprise different widths. The roller shade comprises a roller tube adapted to be attached between the side jambs and proximate to the first jamb, a shade material comprising and extending between a first end attached to the roller tube and a second end, and a shade drive unit operably connected to the roller tube and adapted to rotate the roller tube to roll or unroll the shade material. The shade material comprises a shape that corresponds to a shape of the structural opening such that the shade material substantially covers the structural opening when it is unrolled from the roller tube. The roller shade further comprises a pair of longitudinal side channels each comprises a longitudinal track and adapted to be attached along one of the side jambs and an extendable hem bar assembly attached to the second end of the shade material and comprising a pair of wheels at its opposite terminal ends, wherein each wheel is adapted to be retained by and travel within one of the longitudinal tracks, wherein the longitudinal tracks are adapted to guide the hem bar assembly along the side jambs and control an extension of the pair of extendable arms as the shade material is rolled on or unrolled from the roller tube and the distance between the side jambs changes. The roller shade further comprises a pair of tension modules adapted to be attached proximate to the second jamb, wherein each tension module comprises a retractable cable attached to the hem bar assembly proximate to one of the wheels, wherein the tension modules are adapted to provide tension on the hem bar assembly, wherein the retractable cables extend into and are substantially concealed by the longitudinal side channels.

According to a further aspect of the embodiments, a roller shade is provided adapted to be installed in a non-rectangular structural opening comprising a pair of sides jambs interconnected at their first ends by a first jamb and at their second ends by a second jamb, wherein the first jamb is offset from the second jamb. The roller shade comprises a roller tube adapted to be attached between the side jambs proximate and at an angle with respect to the first jamb such that the roller tube is disposed substantially perpendicular to a direction of travel of the shade material, and a first fascia adapted to be aligned with and attached to the first jamb to substantially conceal the angled roller tube from view. The roller shade further comprises a shade material comprising and extending between a first end attached to the roller tube and a second end, wherein the shade material comprises a shape that corresponds to a shape of the structural opening such that the shade material substantially covers the structural opening when it is unrolled from the roller tube. The roller shade also comprises a shade drive unit operably connected to the roller tube and adapted to rotate the roller tube to roll or unroll the shade material. The roller shade further comprises a pair of longitudinal side channels each comprising a longitudinal track and adapted to be attached along one of the side jambs and a hem bar assembly attached to the second end of the shade material such that the hem bar assembly is parallel to the second jamb, wherein the hem bar assembly comprises a pair of wheels at its opposite terminal ends, wherein each wheel is adapted to be retained by and travel within one of the longitudinal tracks. The roller shade further comprises a pair of tension modules adapted to be attached proximate to the second jamb, wherein each tension module comprises a retractable cable attached to the hem bar assembly proximate to one of the wheels, wherein the tension modules are adapted to provide tension on the hem bar assembly.

According to yet another aspect of the embodiments, a roller shade is provided adapted to be installed in a non-rectangular structural opening comprising a pair of sides jambs interconnected at their first ends by a first jamb and at their second ends by a second jamb, wherein the first jamb is offset from and comprises a different width than the second jamb. The roller shade comprises a roller tube adapted to be attached between the side jambs proximate and at an angle with respect to the first jamb such that the roller tube is disposed substantially perpendicular to a direction of travel of the shade material. The roller shade comprises a shade material comprising and extending between a first end attached to the roller tube and a second end, wherein the shade material comprises a shape that corresponds to a shape of the structural opening such that the shade material substantially covers the structural opening when it is unrolled from the roller tube. The roller shade also comprises a shade drive unit operably connected to the roller tube and adapted to rotate the roller tube to roll or unroll the shade material. The roller shade further comprises a pair of longitudinal side channels each comprising a longitudinal track and adapted to be attached along one of the side jambs, and an extendable hem bar assembly attached to the second end of the shade material such that the hem bar assembly is parallel to the second jamb, wherein the hem bar assembly comprises a pair of wheels at its opposite terminal ends, wherein each wheel is adapted to be retained by and travel within one of the longitudinal tracks, wherein the longitudinal tracks are adapted to guide the hem bar assembly along the side jambs and control an extension of the pair of extendable arms as the shade material is rolled on or unrolled from the roller tube and the distance between the side jambs changes. The roller shade also comprises a pair of tension modules adapted to be attached proximate to the second jamb, wherein each tension module comprises a retractable cable attached to the hem bar assembly proximate to one of the wheels, wherein the tension modules are adapted to provide tension on the hem bar assembly. According to an embodiment, the roller shade further comprises a first fascia adapted to be aligned with and attached to the first jamb to substantially conceal the angled roller tube from view.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWINGS

Figure 1A:
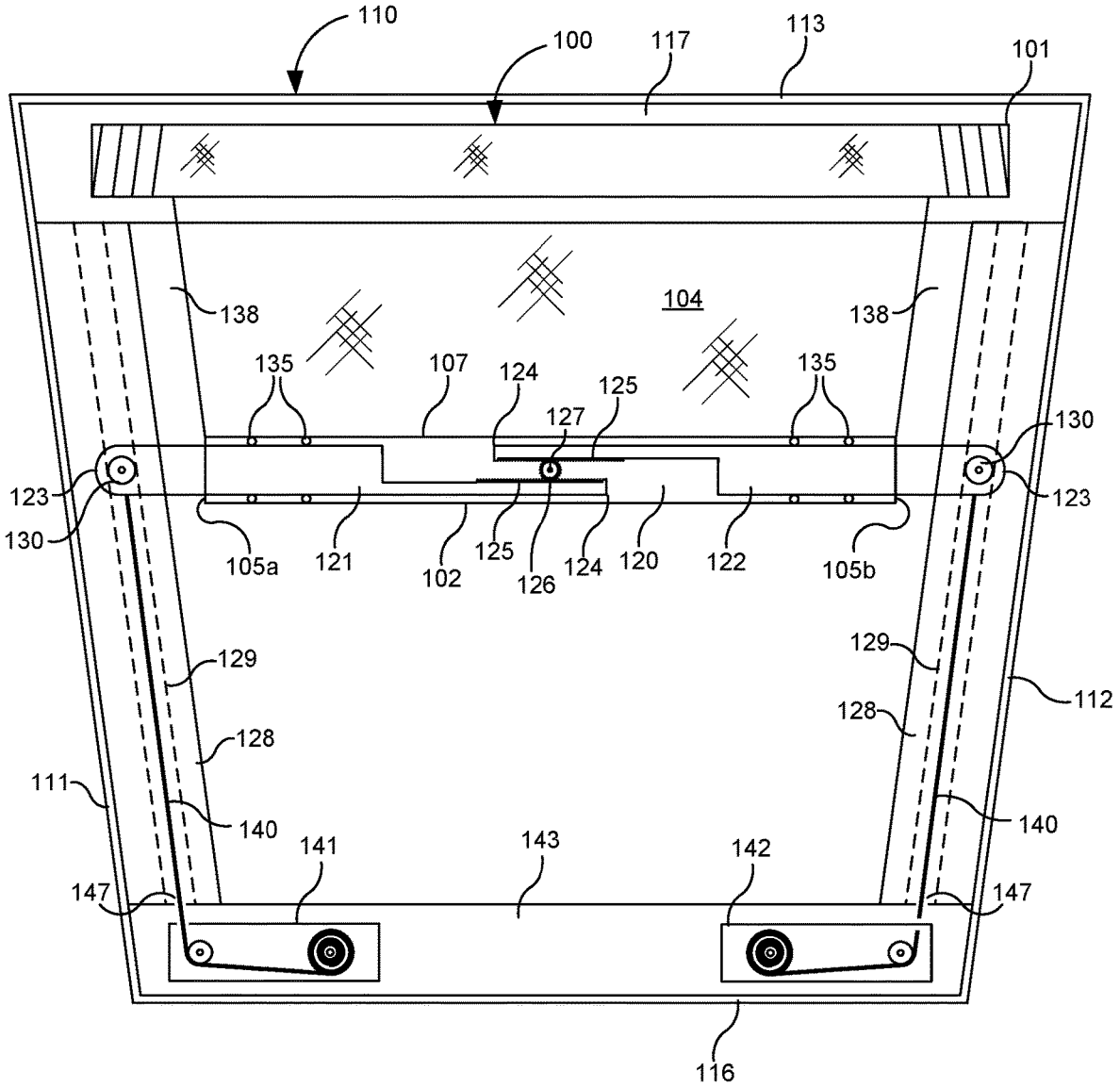

FIG. 1A illustrates a front view of a roller shade installed in a trapezoidal shaped window in a partially opened position according to an illustrative embodiment.

Figure 1B:
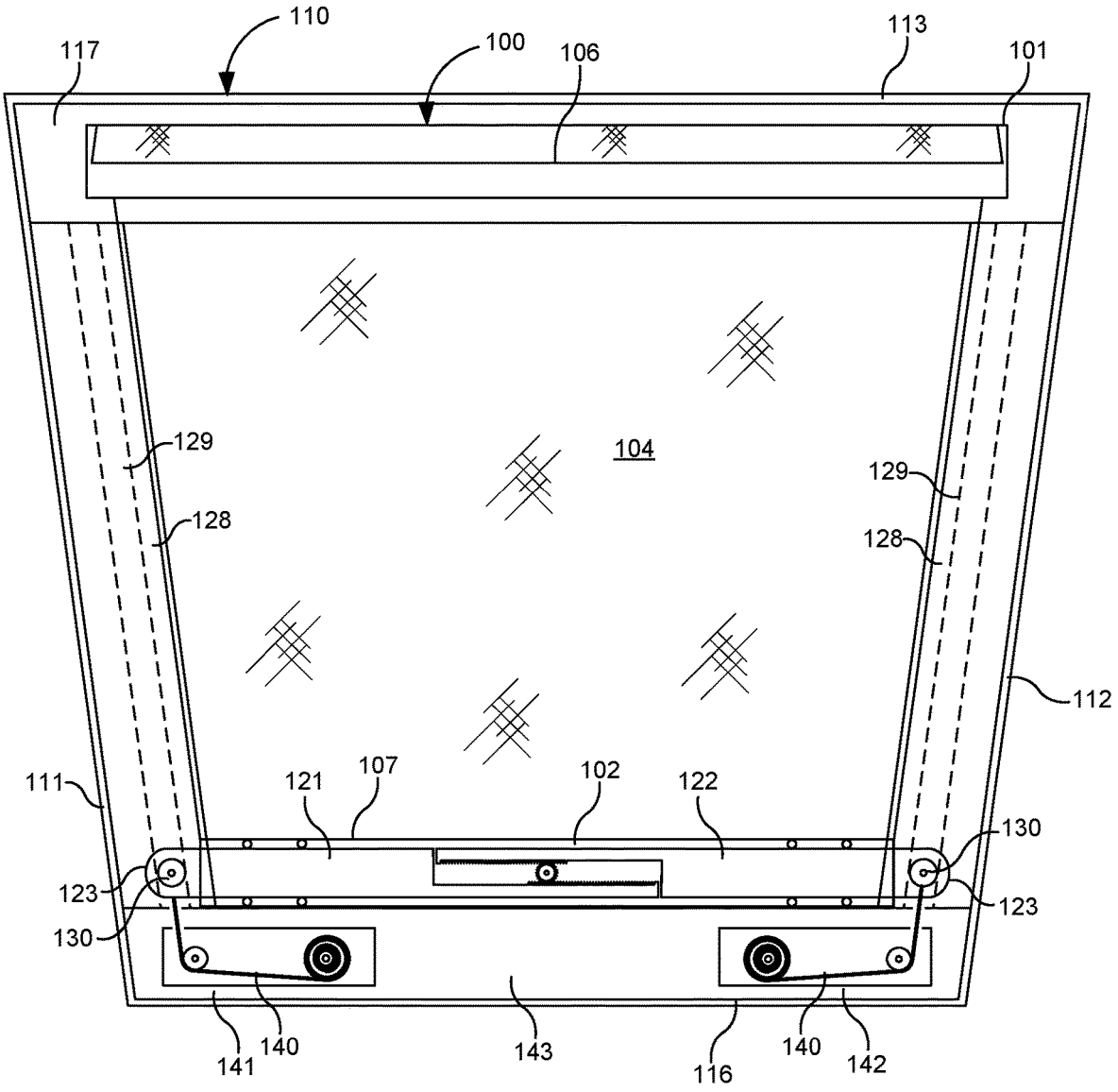

FIG. 1B illustrates a front view of the roller shade installed in a trapezoidal shaped window in a fully closed position according to an illustrative embodiment.

Figure 2:
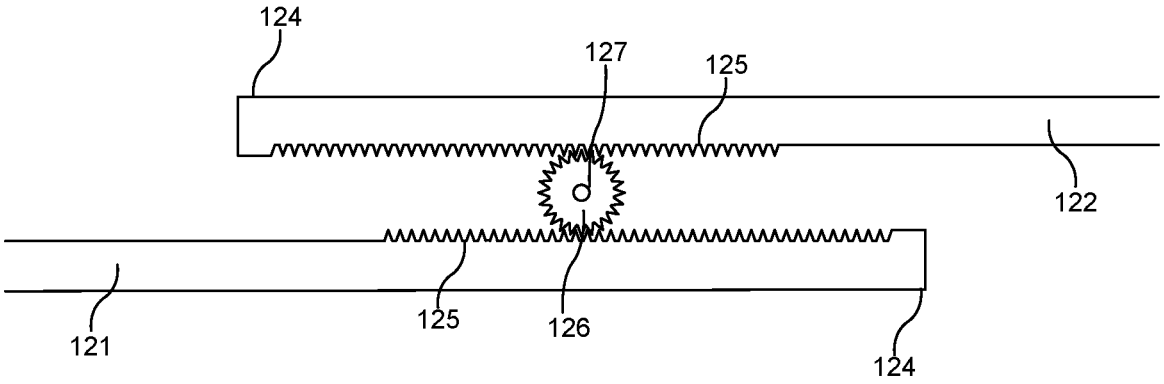

FIG. 2 illustrates a front view of a synchronizing mechanism of the roller shade according to an illustrative embodiment.

Figure 3:
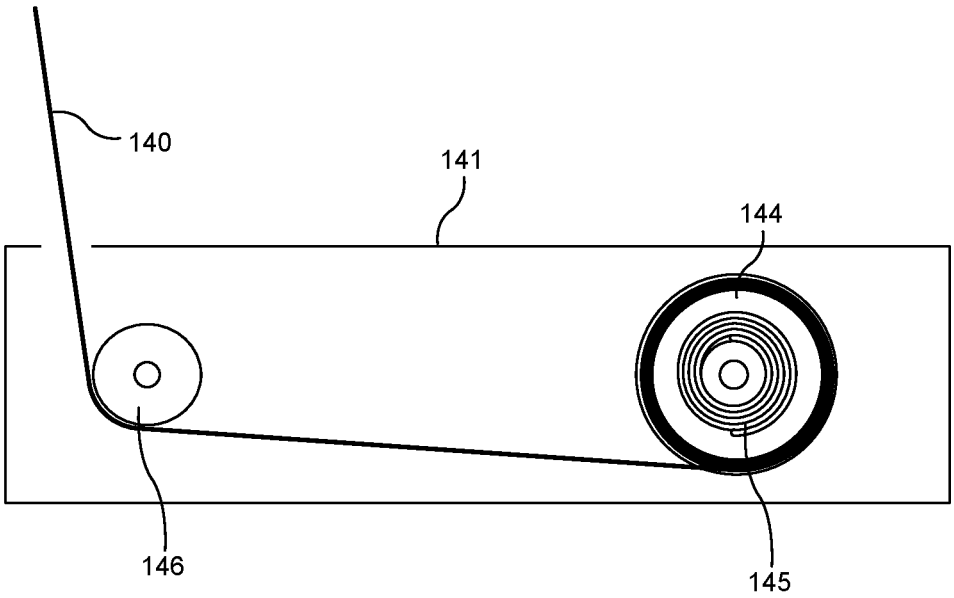

FIG. 3 illustrates a front view of a tensioning module of the roller shade according to an illustrative embodiment.

Figure 4:
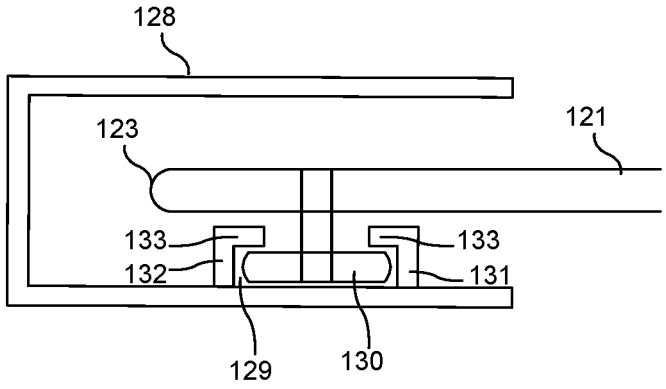

FIG. 4 illustrates a cross sectional top view of a side channel with a hem bar wheel and arm disposed therein according to an illustrative embodiment.

Figure 5:
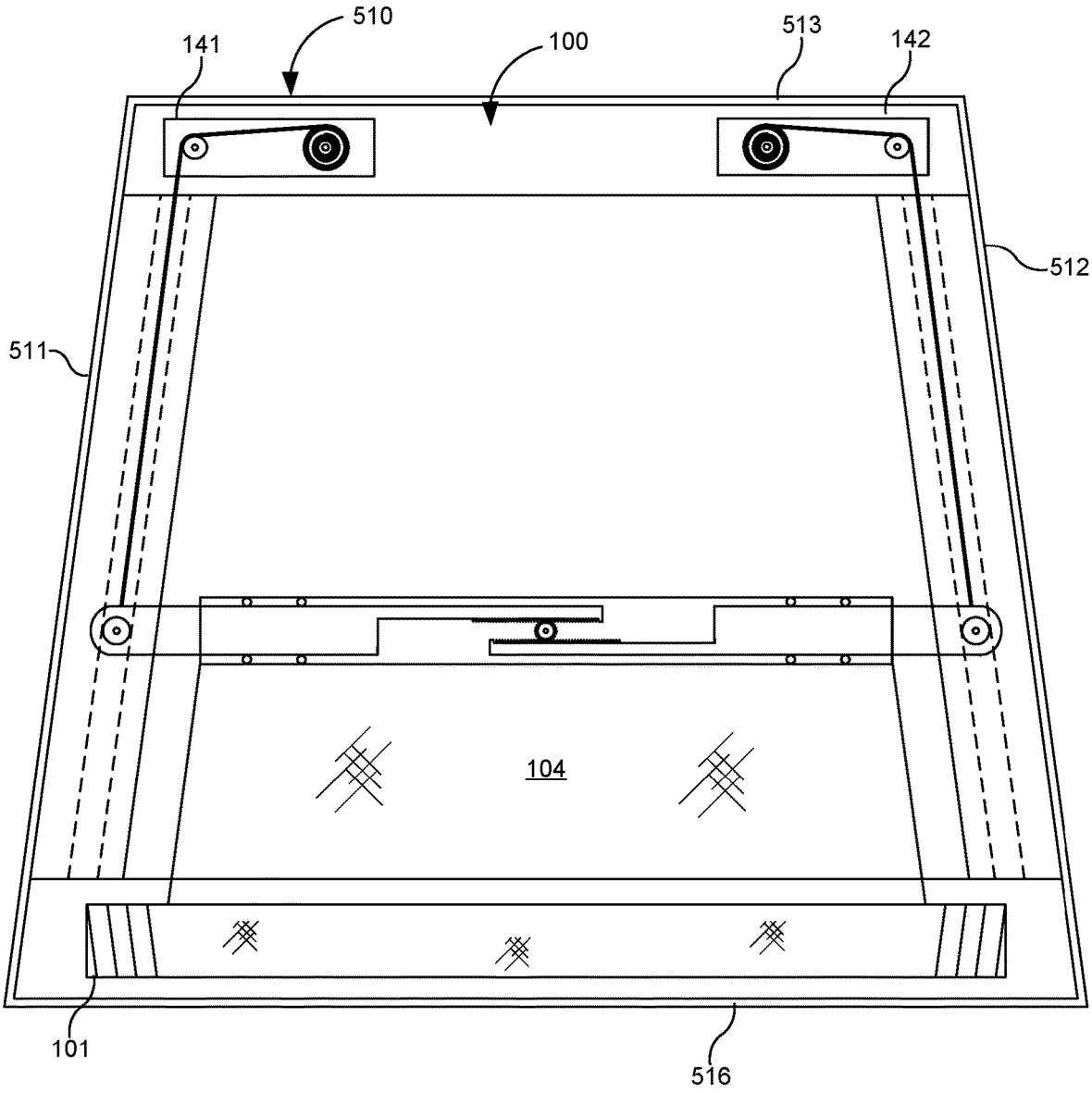

FIG. 5 illustrates a front view of the roller shade in a bottom up configuration according to an illustrative embodiment.

Figure 6:
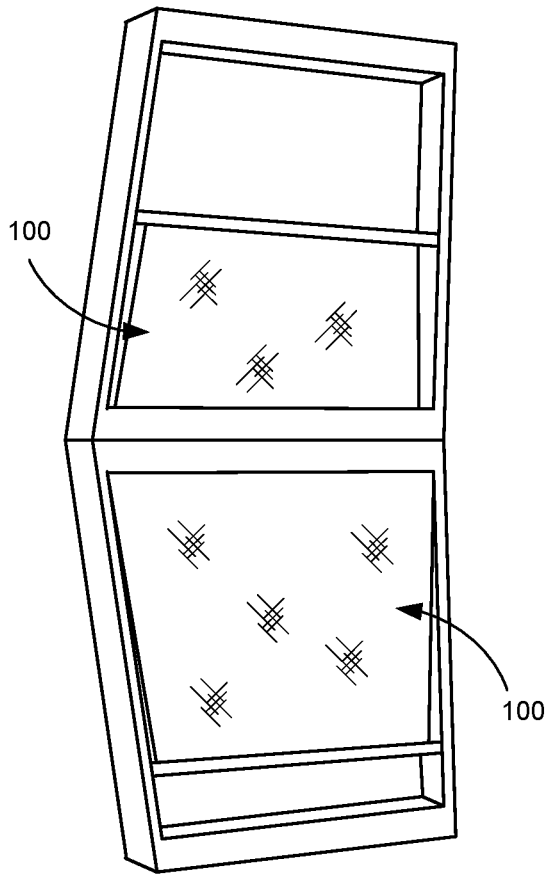

FIG. 6 illustrate a perspective view of two roller shades installed in differently oriented and tilted windows according to an illustrative embodiment.

Figure 7:
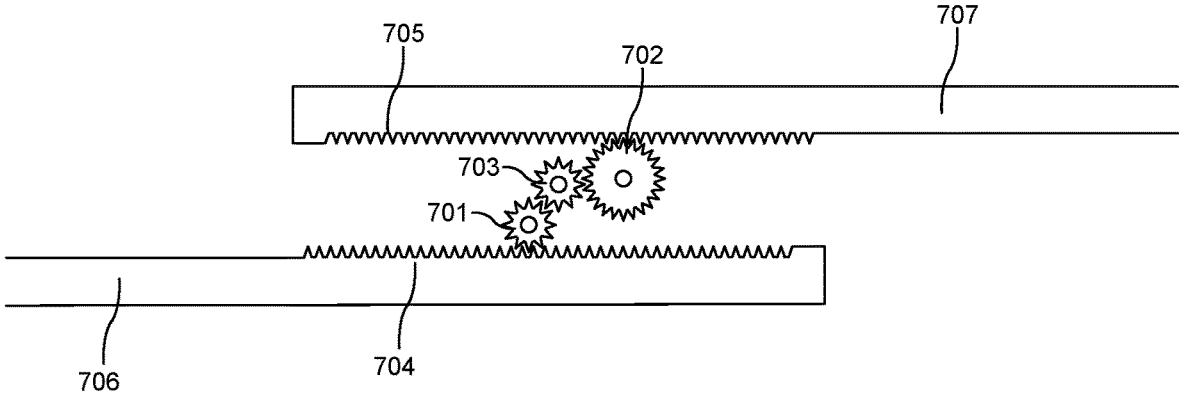

FIG. 7 illustrates a front view of a synchronizing mechanism of the roller shade according to another illustrative embodiment.

Figure 8A:
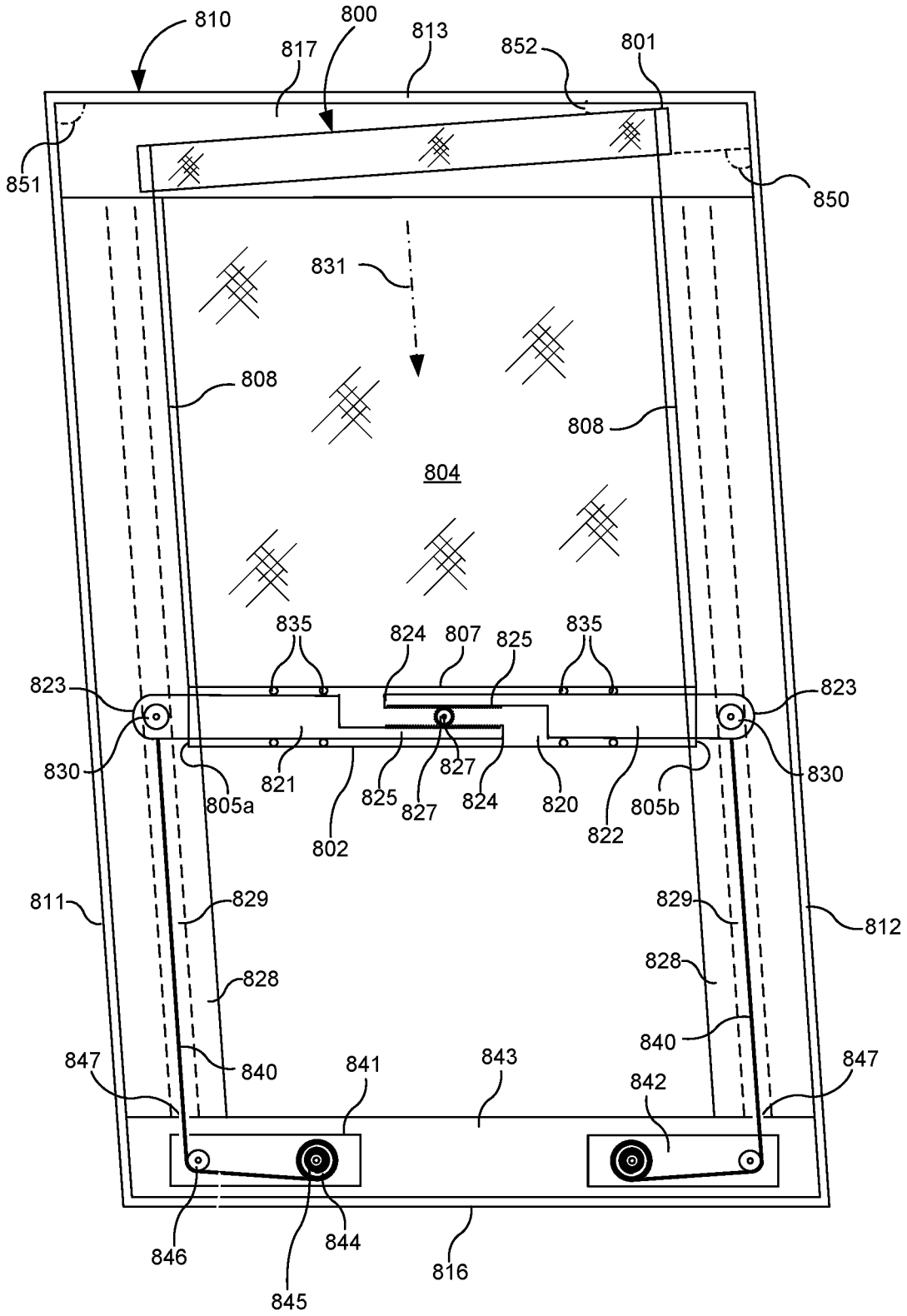

FIG. 8A illustrates a front view of a roller shade installed in a parallelogram shaped window in a partially opened position according to an illustrative embodiment.

Figure 8B:
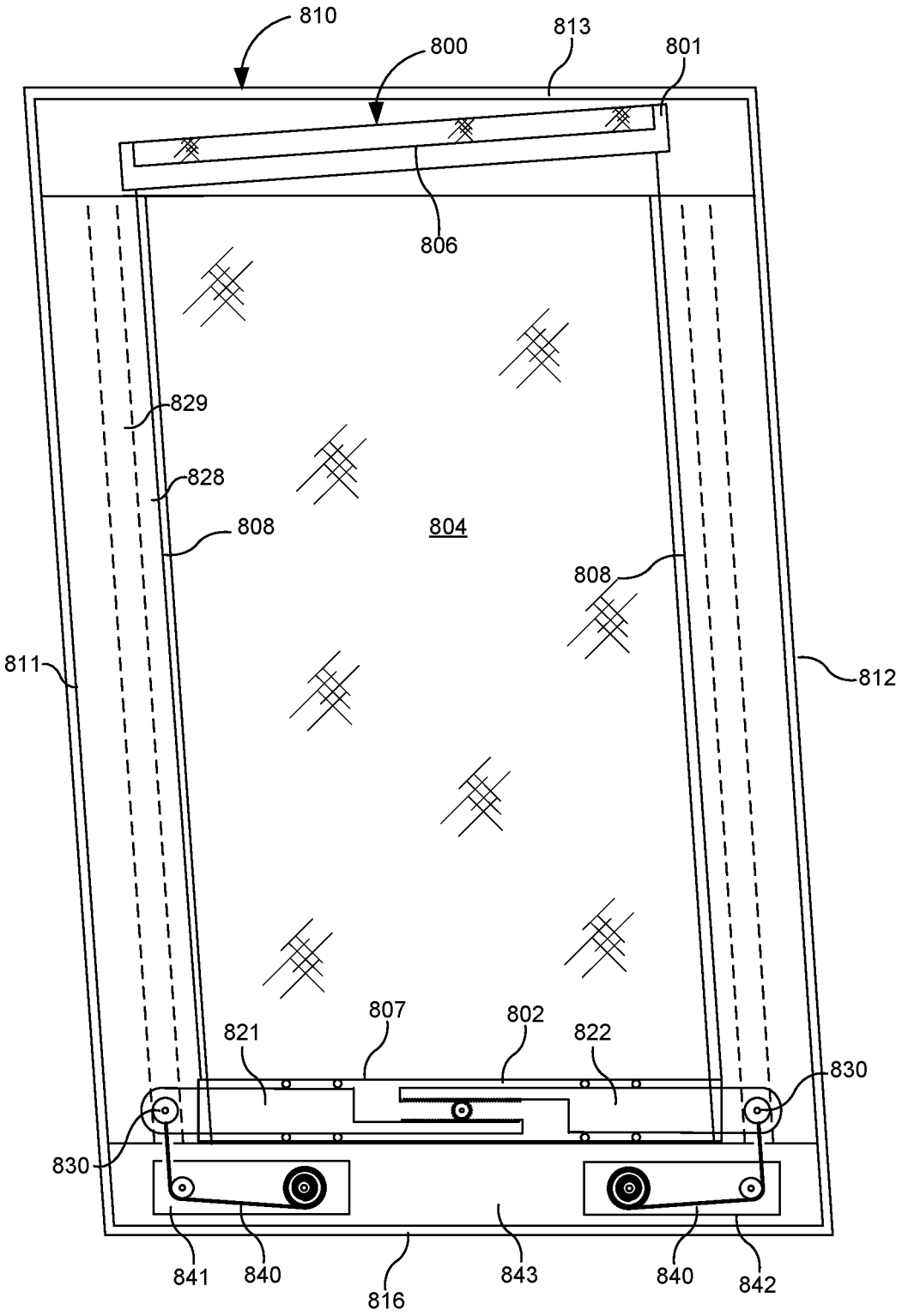

FIG. 8B illustrates a front view of the roller shade installed in a parallelogram shaped window in a fully closed position according to an illustrative embodiment.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims. The detailed description that follows is written from the point of view of a control systems company, so it is to be understood that generally the concepts discussed herein are applicable to various subsystems and not limited to only a particular controlled device or class of devices.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Roller Shade
101 Roller Tube
102 Hem Bar
104 Shade Material
105*a* First Open End
105*b* Second Open End
106 First End
107 Second End
110 Window Frame
111 Side Jamb
112 Side Jamb
113 Head Jamb
116 Sill
117 First Fascia
120 Housing
121 First Arm
122 Second Arm
123 First End
124 Second End
125 Gear Rack
126 Idler Gear
127 Pinion
128 Side Channels
129 Track
130 Wheels
131 Inner Wall
132 Outer Wall
133 Lips
135 Rollers
138 Gaps
140 Cables
141 First Tension Module
142 Second Tension Module
143 Second Fascia
144 Cable Mandrel
145 Constant Force Spring
146 Pulley
147 Holes
510 Window Frame
511 Side Jamb
512 Side Jamb
513 Head Jamb
516 Sill
701 First Idler Gear
702 Second Idler Gear

703 Third Idler Gear
704 First Gear Rack
705 Second Gear Rack
706 First Arm
707 Second Arm
800 Roller Shade
801 Roller Tube
802 Hem Bar
804 Shade Material
805*a* First Open End
805*b* Second Open End
806 First End of Shade Material
807 Second End of Shade Material
808 Parallel Side Ends of Shade Material
810 Window Frame
811 Side Jamb
812 Side Jamb
813 Head Jamb
816 Sill
817 First Fascia
820 Housing
821 First Arm
822 Second Arm
823 First End
824 Second End
825 Gear Rack
826 Idler Gear
827 Pinion
828 Side Channels
829 Track
830 Wheels
831 Direction of Travel
835 Rollers
840 Cables
841 First Tension Module
842 Second Tension Module
843 Second Fascia
844 Cable Mandrel
845 Constant Force Spring
846 Pulley
847 Holes
850 Right Angle
851 Acute Angle
852 Acute Angle

MODE(S) FOR CARRYING OUT THE INVENTION

For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein can be manufactured by Crestron Electronics, Inc., located in Rockleigh, N.J.

The different aspects of the embodiments described herein pertain to the context of roller shades, but is not limited thereto, except as may be set forth expressly in the appended claims. While the roller shade is described herein for covering a window, the roller shade may be used to cover doors, wall openings, or other openings of a structure. The embodiments described herein may further be adapted in other types of window or door shades, such as inverted rollers, Roman shades, Austrian shades, pleated shades, blinds, shutters, skylight shades, garage doors, or the like.

The roller shade of the present embodiments, is adapted to be mounted in a non-rectangular window, such as a trapezoidal window or a parallelogram window, and may be adapted to be mounted in other oddly shaped windows, including regular or irregular quadrilateral shaped windows. In addition, the roller shade of the present embodiments is further adapted to be mounted in different orientations and tilt angles—including a top down orientation and bottom up orientation as discussed below, or sideways configurations, and in windows that tilt toward or away from a room. In tilted windows, the shade material of the roller shade hangs and travels parallel to the window such that the fabric is sloped at the same angle as the window, resulting in a roller shade that does not encroach or diminish from the living space. Using a hem bar synchronizing mechanism, tension modules, and unique mounting hardware, the roller shade of the present embodiments can completely cover differently shaped window types for total privacy with the option to have a limited light gap and increased view to achieve the most privacy.

Referring to FIGS. 1A and 1B there is shown a roller shade 100 installed in a trapezoidal shaped window where FIG. 1A illustrates a front view of the roller shade 100 in a partially opened position and FIG. 1B illustrates a front view of the roller shade 100 in a fully closed position according to one embodiment. Roller shade 100 generally comprise a roller tube 101, shade material 104, and a hem bar 102. The roller tube 101 may be generally cylindrical in shape. The shade material 104 wraps around the roller tube 101 and is unraveled from the roller tube 101 to cover a window, a door, a wall opening, or other structural opening. In various embodiments, the shade material 104 may comprise fabric, plastic, vinyl, or other materials known to those skilled in the art.

According to various embodiments, the roller shade 100 may comprise a shade drive unit adapted raise or lower the shade material 104 to open or close the structural opening, such as a window frame 110. In a roller shade implementation, the shade drive unit may be at least partially received within the roller tube 101 and may be adapted to rotate the roller tube 101 to roll or unroll the shade material 104. According to one embodiment, the shade drive unit may comprise a mechanical drive assembly for manual or semi-manual operation of the shade 100, for example, allowing adjusting of the shade 100 by pulling or tugging on the hem bar 102 or by pulling on a chain.

According to another embodiment, the shade drive unit may comprise a motor for motorized operation of the shade. In a motorized implementation of the roller shade 100, the shade drive unit may include a motor control module, a motor, and a drive wheel that fit within the roller tube 101. The motor control module may comprise fully integrated electronics to control the motor, directing the operation of the motor, including its direction, speed, and position. While the motor remains stationary, the drive wheel may be connected to the output shaft of the motor to rotate the roller tube 101. In operation, the shade material 104 is rolled or unrolled from the roller tube 101 via the roller shade drive unit. As a result, in a top down roller shade, as shown in FIGS. 1A and 1B, the shade material 104 may be lowered from an opened or rolled up position, when substantially the entire shade material 104 is rolled on the roller tube 101, to a closed or rolled down position, when the shade material 104 is substantially unrolled from the roller tube 101.

The roller shade 100 may be mounted within a window frame 110 comprising a pair of side jambs 111 and 112 interconnected at their top ends by a head jamb 113 and at their bottom ends by a sill 116. According to one embodiment, the window frame 110 may comprise a non-rectangular shape, with unparalleled side jambs 111 and 112. As shown in FIGS. 1A and 1B, the window frame 110 may comprise a trapezoidal shape with parallel head jamb 113 and sill 116 and upwardly slanted side jambs 111 and 112, such that the head jamb 113 is wider than the sill 116. Although as described below, window frame 110 may comprise different configuration. The window frame 110 may be oriented orthogonal to a building floor, or in other embodiments, the window frame 110 may be tilted or inclined away from or towards a room. According to one embodiment, the roller tube 101 may be mounted between the pair of side jambs 111 and 112 in proximity of the head jamb 113 via a pair of shade mounting brackets. Each mounting bracket may be secured to a side jamb 111/112 via screws. In other embodiments, the roller tube 101 may be mounted on a wall, in front of the frame enclosing a window, a door, an opening, or the like. According to an embodiment, the roller tube 101 may be concealed from view via a first fascia 117, which may be secured to the mounting brackets or to the head jamb 113. The fascia 117 may comprise an L shaped or a U shaped cross section with an opening from which the shade material 104 extends out of the fascia 117.

According to an embodiment, shade material 104 may comprise a shape that corresponds to the opening of the window frame 110 such that shade material 104 substantially covers the entire opening when it is unrolled from the roller tube 101. For example, the shade material 104 may comprise a trapezoidal shape with a wider first end 106 connected to the roller tube 101 (FIG. 1B), and it may get narrower toward a narrow second end 107 connected to the hem bar 102.

The hem bar 102 is secured to the second end 107 of the shade material 104 such that it runs longitudinally and laterally across the width of the shade material 104. The hem bar 102 can comprise a housing 120 with a hollow construction, which may comprise a circular, oval, or other shaped cross section. Housing 120 may comprise a first open end 105*a* and a second open end 105*b*. The hem bar 102 may further comprise a first and second extendable arms 121 and 122 each partially residing within the hem bar housing 120 and partially extending from the first open end 105*a* and the second open end 105*b*, respectively. The arms 121 and 122 may comprise substantially the same configuration, but may be placed in an inverted mirror image orientation with respect to each other. Each arm 121 and 122 may comprise a longitudinal body extending from a first outer end 123 to a second inner end 124. Each arm 121 and 122 may comprise a wheel 130 proximate to the first end 123 and a gear rack 125 proximate to the second end 124.

The roller shade 100 may further comprise a pair of side channels 128 each secured to respective side jambs 111 and 112, for example via screws. Side channels 128 may comprise an L shaped or a U shaped cross section. While shown with exaggerated width, side channels 128 may comprise a small profile of about 1 inch or 1.75 inch width, although other widths can be used. As shown in FIG. 4, each side channel 128 may receive therein the first end 123 of a respective arm 121 and may be used to conceal it from view. In addition, each side channel 128 may comprise a track 129 adapted to retain a respective wheel 130 therein. The tracks 129 are adapted to guide the hem bar 102 and shade material 104 along the window frame 110 and control the extension of arms 121 and 122 of the hem bar 102 as the shade material 104 is rolled or unrolled from the roller tube 101, as discussed below. Particularly, each track 129 is adapted to encapsulate a respective wheel 130 in both inward and outward direction of the wheel 130 such that the wheel 130 is supported on two opposite sides. For example, the track 129 may comprise an inner wall 131 to engage the inner side of the wheel 130 and an outer wall 132 to engage the outer side of the wheel 130. Each of the inner and outer walls 131 and 132 of the track 130 may further comprise a laterally and inwardly extending lip 133 adapted to retain a respective wheel 130 within the track 129.

Referring back to FIGS. 1A and 1B, as the shade material 104 is rolled or unrolled from the roller tube 101, the longitudinal hem bar 102 travels substantially orthogonally with respect to the side channels 128 causing the wheels 130 of the hem bar 102 to travel within the tracks 129 and substantially along and parallel to respective side jambs 111 and 112 of the window frame 110. Because the horizontal distance between the side jambs 111 and 112, and thereby the tracks 129 changes as the hem bar 102 travels with respect to side channels 128, the arms 121 and 122 extend from or retract into the side openings of the hem bar housing 120 as a result of the wheels 130 pulling or pushing on the arms 121 and 122 as they travel within tracks 129.

As shown in greater detail in FIG. 2, the hem bar 102 may further comprise an idler gear 126 which may rotate about a pinion 127. According to an embodiment, the pinion 127 may be attached to the hem bar housing 120 at about the center of the housing 120 such that the idler gear 126 is stationary to the center of the hem bar 102. The teeth of the gear racks 125 of the pair of arms 121 and 122 may engage the teeth of the idler gear 126 on opposite sides of the idler gear 126. The idler gear 126 and the pair of gear racks 125 cooperatively act as a synchronizing mechanism to synchronize the distance the arms 121 and 122 extend out of the side openings of the hem bar housing 120. For example, if the first arm 121 is pulled out of the hem bar housing 120 by a distance, the gear rack 125 of the first arm 121 is also pulled, which rotates the idler gear 126 and pushes out the other gear rack 125 of the second arm 122 out of the hem bar housing 120 by the same distance. As the hem bar 102 travels with respect to the side channels 128, the wheels 130 travel within tracks 129 and are forced by the inner wall 113 and/or the outer wall 132 of the tracks 129 to be displaced closer or farther from each other, depending on the direction of travel. The wheels 130 as a result pull or push on the arms 121 and 122, causing the arms 121 and 122 to extent from or retract into the hem bar housing 120. A plurality of rollers 135 may be rotatably disposed within the hem bar housing 120 about the longitudinal sides of the arms 121 and 122 to guide the arms 121 and 122 out of and into the housing 120 and also to ensure that the arms 121 and 122 extend and retract with minimal friction. The movement of either of the arms 121 or 122 in either direction with respect to the housing 120 will move the other one of the arms 121 or 122 in an opposite direction by the same distance. The synchronizing mechanism also ensures that the first ends 123 of the arms 121 and 122 are equidistant from the center of the hem bar 102. This ensures that the shade material 104 is not biased left or right when it is rolled or unrolled from the roller tube 101, ensuring that the shade material 104 does not wrinkle or skew.

According to another embodiment, in order to accommodate a skewed or non-isosceles trapezoidal shaped architectural openings (i.e., which contains side jambs of unequal lengths) the synchronizing mechanism may contain a plurality of idler gears as shown in FIG. 7. For example, the synchronizing mechanism may comprise a first idler gear 701, a second idler gear 702, and a third idler gear 703. The teeth of the first idler gear 701 may engage the teeth of a first gear rack 704 of a first arm 706 and the teeth of the second idler gear 702 may engage the teeth of the second gear rack 705 of a second arm 707. The teeth of the first and the second gears 701 and 702 may further engage the teeth of the third gear 703. The first, second, and third gears 701, 702, and 703 may contain different gear ratios and as such rotate at different speeds to allow the first arm 706 to extend a different distance than the second arm 707. As such, the synchronizing mechanism shown in FIG. 7 may allow the hem bar to lower parallel to the roller tube such that the shade material does not wrinkle or skew.

Referring back to FIGS. 1A and 1B, according to an embodiment, roller shade 100 further comprises a pair of tension modules, including a first tension module 141 and a second tension module 142. Tension module 141 and 142 are adapted to be secured to the window frame 110 across and opposite from the roller tube 101. In the configuration shown in FIGS. 1A and 1B, where the roller tube 101 is secured proximate to the head jamb 113, tension modules 141 and 142 are secured to or proximate to the sill 116. Tension modules 141 and 142 may be encapsulated and hidden by a second fascia 143 adapted to be secured to the window frame 110, for example to the sill 116. According to various embodiments, second fascia 143 may comprise an L shaped, U shaped, or a rectangular cross section. The first fascia 117, the second fascia 143, and the pair of side channels 128 may be seamlessly interconnected to conceal the mechanical components of the roller shade 100 from view. According to another embodiment, the first fascia 117, the second fascia 143, and the pair of side channels 128 may be incorporated into a single fascia, instead of multiple interlocking pieces.

As shown in greater detail in FIG. 3, each tension module, such as tension module 141, may comprise a retractable cord or cable 140 extending therefrom. The cable 140 may be wound around a cable mandrel 144 rotatably secured within the tension module 141 such that the cable 140 may extend form the tension module 141 by being unwound from the mandrel 144 or retract into the tension module 141 by being wound on the mandrel 144. Mandrel 144 may be biased by a constant force spring 145, which can cooperate with the cable mandrel 144 to tighten or loosen the spring 145. When the cable 140 is pulled from the tension module 141, the spring 145 tightens and provides a torque that translates to the cable 140, which provides a force. When the cable is then let go, it is retracted back into the tension module 141 by the torque built in the spring 145 causing the spring 145 to loosen. Each tension module 141 and 142 may further comprise a pulley 146 to change the direction of force applied to the cable 140.

Referring back to FIGS. 1A and 1B, the tension modules 141 and 142 may be fully encapsulated within the second fascia 143. The second fascia 143 may contain a pair of holes 147 through which the cables 140 extend. According to an embodiment, the second fascia 143 may comprise a tubular shape with holes extending from its side to accommodate the cables 104. Each extending terminal end of the cables 140 may be anchored or attached to a respective first ends 123 of the respective first and second arms 121 and 122. The cables 140 may extend from the second fascia 143 into the side channels 128 and/or tracks 129 such as they are hidden from view. The tension modules 141 and 142 provide tension on the wheels 130, exerting a force to pull the wheels 130 toward the tension modules 141 and 142, opposite to the roller tube 101. This tension is translated to the hem bar 102 which pulls the second end 107 of the shade material 104 with respect to the roller tube 101 such that it hangs straight, without buckling or rippling. A constant force spring 145 ensures that constant pulling force is provided by each cable 140 over the full travel of the hem bar 102 and shade material 104.

As shown in FIGS. 1A and 1B, roller shade 100 may be mounted in a top down configuration in a window frame 110 or architectural opening by attaching the roller tube 101 proximate to the wider head jamb 113 and the tension modules 141 and 142 proximate to the narrower sill 116 of the window frame 110. Beneficially, as shown in FIG. 5, for trapezoidal window frames 510 with a narrow head jamb 513 and a wider sill 516, the roller shade 100 may be mounted in a bottom up configuration. In this configuration, the roller tube 101 is secured proximate to the sill 516 and the tension modules 141 and 142 are secured proximate to the head jamb 513. The tension provided by the tension modules 141 and 142 on the shade material 104 stretches the shade material 104 in an upward direction as it is unrolled from the roller tube 101. In addition, the tensioned configuration of the roller shade 100 may be mounted in tilted or sloped windows as tension on the shade material 104 is maintained regardless of the tilt angle of the roller shade 100. For example, as shown in FIG. 6, roller shades 100 may be utilized to cover a plurality of trapezoidal windows of different orientations and tilt angles to create a seamless effect. Sideway configurations are also contemplated by the present embodiments.

In operation, referring to FIG. 1A, the shade material 104 may be unrolled from the roller tube 101 to cover the opening of the window frame 110. As the shade material 104 is unrolled, the hem bar 102 travels along side tracks 129 causing it to contract. The hem bar 102 is also pulled toward the window sill 116 via the tension modules 141 and 142 causing the second end 107 of the shade material 104 to pull away from the roller tube 101 and towards the window sill 116. The shade material 104 lowers until the opening in the window frame 110 is substantially closed as shown in FIG. 1B. While there are initially gaps 138 formed between a side edge of the shade material 104 and the sides of the window frame as shown in FIG. 1A, as the shade material 104 closes, these gaps becomes smaller until they disappear as the shade material 104 reaches the bottom as shown in FIG. 1B because the trapezoidal shaped shade material 104 will fully extend on all sides to cover the window opening. According to an embodiment, in a fully closed position, the shade material 104 may comprise a width that is wider than the distance between the two side channels 128 such that the side edges of the shade material 104 enter the interior space of the side channels 128, eliminating any light gaps between the shade material 104 and the side channels 128.

When the roller tube 101 is rotated in an opposite direction, the shade material 104 is rolled onto the roller tube 101 to uncover the opening of the window frame 110. As the shade material 104 is rolled, the hem bar 102 travels along side tracks 129 causing it to expand. The shade material 104 is raised until the opening in the window frame 110 is substantially opened.

Referring to FIGS. 8A and 8B, the roller shade of the present embodiments may be adapted to be installed in other odd shaped non-rectangular windows, such as a parallelogram shaped window frame 810. Particularly, FIG. 8A illustrates a front view of a roller shade 800 in a partially opened position and FIG. 8B illustrates a front view of the roller shade 800 in a fully closed position installed in window frame 810 according to one embodiment. Roller shade 800 comprises substantially similar configuration to roller shade 100 discussed above. It comprises a roller tube 801, shade material 804, and a hem bar 802. Roller tube 801 may comprise similar configuration to roller tube 101 and may comprise a manual, motorized, or semi-motorized shade drive unit adapted roll or unroll the shade material 804 to open or close the structural opening, such as a window frame 810.

The hem bar 802 comprises a similar configuration as hem bar 102 discussed above including a housing 820 having a first and second open end 805*a* and 805*b* with first and second extendable arms 821 and 822 retractably extending therefrom. Each arm 821 and 822 may comprise a wheel 830 proximate to its first end 823 and a gear rack 825 proximate to its second end 824. The hem bar 802 may comprise a synchronizing mechanism, as discussed above, including an idler gear 826 rotating about a pinion 827 and having teeth that engage the teeth of the gear racks 825 of the pair of arms 821 and 822. The idler gear 826 and the pair of gear racks 825 cooperatively act as a synchronizing mechanism to synchronize the distance the arms 821 and 822 extend out of the side openings 805*a-b* of the hem bar housing 820. A plurality of rollers 835 may be rotatably disposed within the hem bar housing 820 about the longitudinal sides of the arms 821 and 822 to guide the arms 821 and 822 out of and into the housing 820 to ensure that arms 821 and 822 extend and retract with minimal friction.

The roller shade 800 may further comprise a pair of side channels 828, similar to side channels 128, each secured to and parallel with respective side jambs 811 and 812. Side channels 828 may comprise an L shaped or a U shaped cross section. Each side channel 828 receives therein the first end 823 of a respective arm 821 and 822 to conceal it from view. Each side channel 828 comprises a track 829, with similar configuration as track 129, adapted to retain a respective wheel 830 therein. As discussed above, tracks 829 are adapted to guide the hem bar 802 and shade material 804 along the window frame 810 and control the extension of arms 821 and 822 of the hem bar 802 as the shade material 804 is rolled or unrolled from the roller tube 801. Although according to another embodiment, since side jambs 811 and 812 are parallel such that the distance between them does not change, the hem bar 802 may comprise a single non-expandable longitudinal body, which may be directly attached to the lower end of the shade material 804, and which comprising wheels 830 disposed at its opposite ends that travel within tracks 829 of side channels 828.

Roller shade 800 further comprises a pair of tension modules 841 and 842 with similar configuration to tension modules 141 and 142 each comprising a retractable cord or cable 840 wound about cable mandrel 844 and biased via a constant force spring 845. Tension modules 841 and 842 may be secured to the sill 816 across and opposite from the roller tube 801. Tension modules 841 and 842 may be encapsulated and hidden by a second fascia 843 adapted to be secured to the window frame 810. The second fascia 843 may contain a pair of holes 847 through which the cables 840 retractably extend. Second fascia 843 may comprise longitudinal body secured parallel to the sill 816. According to various embodiments, second fascia 843 may comprise an L shaped, U shaped, or a rectangular cross section. The first fascia 817, the second fascia 843, and the pair of side channels 828 may be seamlessly installed parallel to respective head jamb 813, side jambs 811 and 812, and sill 816 of the window frame 810 in an interconnected or single unit configuration to conceal the mechanical components of the roller shade 800 from view. Each extending terminal end of the cables 840 may be anchored or attached to a respective first end 823 of the respective first and second arms 821 and 822. As discussed above, tension modules 841 and 842 provide tension on the wheels 830, which translates to the hem bar 802 to pull the second end 807 of the shade material 804 with respect to the roller tube 801 such that it hangs straight, without buckling or rippling.

The parallelogram shaped window frame 810 may comprise a head jamb 813 parallel to a sill 816 and the horizontal plane. However, head jamb 813 and sill 816 need not be parallel to each other and need not be parallel to the horizontal plane. The window frame 810 further comprises two parallel side jambs 811 and 812. Although as shown above, the roller shade of the present embodiments may be adopted in a window frame containing non-paralleled side jambs. In the shown window frame 810, side jams 811 and 812 may be skewed by an acute angle 851 with respect to the head jamb 813 and sill 816. The window frame 810 may be oriented orthogonal to the building floor, or in other embodiments, the window frame 810 may be tilted or inclined away from or towards a room.

According to one embodiment, the roller tube 801 may be mounted between the pair of side jambs 811 and 812 in proximity of the head jamb 813 via a pair of shade mounting brackets. In other embodiments, the roller tube 801 may be mounted on a wall, in front of the frame enclosing a window, a door, an opening, or the like. According to an embodiment, the roller tube 801 may be mounted perpendicular to the side channels 828 and the side jambs 811 and 812—i.e., the longitudinal body of the roller tube 801 is mounted at a right angle 850 with respect to the side channels 828 and side jambs 811 and 812. However, in a window frame where the side jambs are not parallel to each other, angle 850 may differ. Essentially the roller tube 801 is mounted substantially perpendicular to the desired direction of travel 831. This results in the roller tube 801 to be mounted at an angle, such as acute angle 852, with respect to the head jamb 813 of the window frame 810. To hide the tilt of the roller tube 801 with respect to the head jamb 813, the roller tube 801 may be concealed from view via a first fascia 817, which may be secured to the mounting brackets or to the head jamb 813. The first fascia 817 may comprise an L shaped, U shaped, or similarly shaped cross section with an opening from which the shade material 804 extends out of the fascia 817. First fascia 817 may comprise a longitudinal and rectangular body parallel to the head jamb 813 of the window. In FIGS. 8A and 8B, the first fascia 817 is also aligned with the horizontal plane—creating a pleasing appearance that conforms to the angles of the window frame 810. The fascia 817 height may comprises a height that concealed the angled roller tube 801, as shown in FIGS. 8A and 8B. For example, the fascia height may comprise about 6 inches.

According to an embodiment, shade material 804 may comprise a shape that corresponds to the opening of the window frame 810 such that shade material 804 substantially covers the entire opening when it is unrolled from the roller tube 801 as shown in FIG. 8B. For example, the shade material 804 may comprise a substantially constant width with parallel side ends 808, which are in turn parallel to the side jambs 811 and 812 of the window frame 810. The first end 806 of the shade material 804 connected to the roller tube 801 (FIG. 8B) may be orthogonal to the parallel side ends 808. The second end 807 of the shade material 804 may be cut at an angle to align with the plane of the sill 816. As such, the second end 807 of the shade material 804 is not parallel, but is angled, with respect to the first end 806 of the shade material 804, the width of the shade material 804, and the roller tube 801. Hem bar 802 is secured to the second end 807 of the shade material 804 such that it also at an angle with respect to the roller tube 801 and the width of the shade material 804. As such, when the shade material 804 is in a closed position, as shown in FIG. 8B, hem bar 802 is aligned and parallel with the sill 816 and second fascia 843. This allows the shade material 804 to completely cover the window frame 810 without unsightly angles and light gaps. In window configurations where the head jamb 813 and sill 816 are also not parallel with each other, the hem bar 802 may be configured to be parallel with the sill 816; the first fascia 817 may comprise a longer length to conceal any unsightly angle of the hem bar 802 with respect to the head jamb 813 when the shade material 804 in a fully opened position such that the hem bar 802 entirely enters the space of the first fascia 817.

As discussed above, roller shade 800 may be mounted in a top down configuration in window frame 810 by attaching the roller tube 801 proximate to the head jamb 813 and the tension modules 841 and 842 proximate to the sill 816. Alternatively, the roller shade 800 may be mounted in a bottom up configuration by attaching the roller tube 801 proximate to the sill 816 and the tension modules 841 and 842 to the head jamb 813. Sideway configurations are also contemplated by the present embodiments.

INDUSTRIAL APPLICABILITY

The disclosed embodiments provide a system and a method for a roller shade for a non-rectangular window, such as a trapezoidal, a parallelogram, as well as other regular or irregular quadrilateral shaped windows, and which may be mounted in different orientations and tilt angles. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted.

All United States patents and applications, foreign patents, and publications discussed above are hereby incorporated herein by reference in their entireties.

ALTERNATE EMBODIMENTS

Alternate embodiments may be devised without departing from the spirit or the scope of the different aspects of the embodiments.

What is claimed is:

1. A roller shade adapted to be installed in a non-rectangular structural opening, comprising a pair of side jambs interconnected at their first ends by a first jamb and at their second ends by a second jamb, wherein the roller shade comprises:

a roller tube adapted to be attached between the side jambs and proximate to the first jamb;

a shade material comprising and extending between a first end attached to the roller tube and a second end, wherein the roller tube is adapted to rotate to roll or unroll the shade material, wherein the shade material comprises a shape that corresponds to a shape of the structural opening such that the shade material substantially covers the structural opening when the shade material is unrolled from the roller tube;

a pair of longitudinal side channels each comprising a longitudinal track and adapted to be attached along one of the side jambs;

an extendable hem bar assembly attached to the second end of the shade material and comprising:

a hollow housing with a pair of opposite open ends, a pair of extendable arms each partially residing within the hollow housing and partially extending from a respective one of the opposite open ends of the hollow housing, a pair of wheels each attached proximate to a terminal end of a respective one of the pair of extendable arms, wherein each wheel is adapted to be retained by and travel within a respective one of the longitudinal tracks, and a plurality of rotatable interengaged idler gears disposed within the hollow housing, wherein each of the pair of extendable arms comprise a respective gear rack adapted to engage at least two of the idler gears, wherein the idler gears comprise different gear ratios to allow the pair of extendable arms to extend at different distances from the hollow housing; and a pair of tension modules adapted to be attached proximate to the second jamb, wherein each tension module comprises a retractable cable attached to the hem bar assembly proximate to one of the wheels, wherein the tension modules are adapted to provide tension on the hem bar assembly.

2. The roller shade of claim 1, wherein each of the longitudinal side channels is adapted to receive a respective terminal end of one of the pair of extendable arms.

3. The roller shade of claim 1, wherein the longitudinal tracks are adapted to guide the hem bar assembly along the side jambs and control an extension of the pair of extendable arms as distance between the side jambs changes.

4. The roller shade of claim 1, wherein the pair of side jambs of the non-rectangular structural opening are not parallel causing the pair of extendable arms to extend from or retract into the open ends of the hollow housing as the shade material is rolled on or unrolled from the roller tube.

5. The roller shade of claim 1, wherein the idler gears and the pair of gear racks cooperatively act as a synchronizing mechanism to synchronize a distance the pair of extendable arms extend out of the pair of open ends of the hollow housing.

6. The roller shade of claim 1, wherein the hollow housing comprises a plurality of rollers rotatably disposed about the extendable arms to guide the extendable arms therein.

7. The roller shade of claim 1 further comprising a fascia adapted to be attached to the second jamb to substantially conceal the pair of tension modules from view.

8. The roller shade of claim 7, wherein the fascia comprises a pair of holes through which the retractable cables exit the fascia.

9. The roller shade of claim 8, wherein the retractable cables extend into and are substantially concealed by the longitudinal side channels.

10. The roller shade of claim 1, wherein the first jamb is offset from the second jamb of the non-rectangular opening, wherein the roller tube is adapted to be attached between the side jambs at an angle with respect to the first jamb.

11. The roller shade of claim 10, further comprising a fascia adapted to be aligned with and attached to the first jamb to substantially conceal the angled roller tube from view.

12. The roller shade of claim 10, wherein the roller tube is adapted to be attached between the side jambs substantially perpendicularly to a direction of travel of the shade material.

13. The roller shade of claim 10, wherein the hem bar assembly is adapted to be attached to the second end of the shade material such that the hem bar assembly is parallel to the second jamb.

* * * * *